US005341608A

United States Patent [19]

Mains, Jr.

[11] Patent Number: 5,341,608

[45] Date of Patent: * Aug. 30, 1994

[54] METHOD AND APPARATUS FOR MATERIAL REMOVAL

[76] Inventor: Gilbert L. Mains, Jr., 1200 Hayes Industrial Dr., Marietta, Ga. 30062

[ * ] Notice: The portion of the term of this patent subsequent to Jun. 29, 2010 has been disclaimed.

[21] Appl. No.: 986,379

[22] Filed: Dec. 7, 1992

Related U.S. Application Data

[63] Continuation of Ser. No. 684,979, Apr. 10, 1991, Pat. No. 5,222,332.

[51] Int. Cl.[5] ..... B24C 1/00

[52] U.S. Cl. ..... 51/320; 51/321; 51/322; 51/439; 83/53; 83/169; 83/177

[58] Field of Search ..... 51/320, 321, 322, 410, 51/439; 83/16, 53, 169, 177; 134/6, 7; 225/1, 93.5

[56] References Cited

U.S. PATENT DOCUMENTS 4,829,859 5/1989 Yankoff ..... 407/11 X
5,009,240 4/1991 Levi ..... 51/439 X
5,165,602 11/1992 Arnout et al. ..... 83/177 X
5,222,332 6/1993 Mains, Jr. ..... 83/177 X

FOREIGN PATENT DOCUMENTS 2475425 8/1981 France ..... 51/320
2042399 9/1980 United Kingdom ..... 51/410

*Primary Examiner*—Richard K. Seidel
*Assistant Examiner*—Raymond D. Woods
*Attorney, Agent, or Firm*—Reising, Ethington, Barnard, Perry & Milton

[57] ABSTRACT

A method and apparatus that allows the removal of solid material from a workpiece utilizes a high velocity stream of ice which is caused to impinge on the workpiece. A working liquid, such as water, is supplied at high pressure to a discharge nozzle with an orifice for forming the needle-like stream. The water is cooled before it reaches the nozzle to a temperature below its freezing point so that at least some of the stream is transformed to ice. Optionally, the stream is cooled after it is emitted from the orifice by flowing an envelope of cryogenic gas around the emitted stream.

13 Claims, 2 Drawing Sheets

METHOD AND APPARATUS FOR MATERIAL REMOVAL

This is a continuation of application Ser. No. 07/684,979 filed on Apr. 10, 1991, U.S. Pat. No. 5,222,332.

FIELD OF THE INVENTION

This invention relates to a method and apparatus for removal of material from solid bodies; more particularly, it relates to material removal by the use of a high velocity jet formed from a liquid.

BACKGROUND OF THE INVENTION

There are many industrial operations which require processing of solid workpieces by material removal to cut, shape or clean the workpiece. It is already known, and commonly used in industry, to utilize high pressure, high velocity liquid jets for such material removal operations. These known methods and apparatus have achieved a high state of development but still leave much to be desired in respect to efficiency of material removal and residual effects on the workpiece and on the work site.

In the prior art, solid workpieces of hard material are cut by use of high velocity liquid jets which effect the cut by material removal in particulate form from the kerf. In some applications, an abrasive material is added to the jet stream to enhance the cutting action. Water and other liquids have been proposed for use in the formation of the jet stream. This cutting technique has been proposed for application to cutting of metal workpieces including exotic metals which are extremely hard. It has also been proposed for use in cutting composite materials, concrete and stone.

It has been a common practice to clean the surfaces by the use of sand blasting and the use of water blasting with entrained abrasive particles, for example in the removal of unwanted deposits on the exterior walls of buildings of brick and stone. This method of material removal typically leaves a very large amount of residue of the working fluid.

The prior art methods and apparatus for material removal as discussed above, are inefficient, produce a low rate of material removal and leave an unduly large amount of residue and waste at the work site. There is a need to overcome such disadvantages in a wide variety of industrial applications. A particular application, for example, is stone cutting in quarrying operations. In such operations, such as the mining of granite blocks, the cutting operation has to be performed in a relatively confined area wherein the cutting tool has to be manually supervised and controlled or sometimes manually manipulated. In such an operation, huge blocks of granite weighing many tons, for example, are cut in rectangular form from a monolith of great extent. It is desirable to sever the block with a narrow kerf and thereby minimize the amount of material removal required. It is also desirable to minimize the contamination of the air in the work area and to leave only a minimum amount of harmless residue.

The following patents relate to methods and apparatus for material removal by use of the high velocity jet stream of liquid or other material: U.S. Pat. No. 2,985,050 Schwacha, issued May 23, 1961; U.S. Pat. No. 3,746,256 Hall et al, issued Jul. 17, 1973; U.S. Pat. No. 4,594,924 Windisch, issued Jun. 17, 1986; U.S. Pat. No. 4,686,877 Jaritz et al, issued Aug. 18, 1987; U.S. Pat. No. 4,693,153 Wainwright et al, issued Sep. 15, 1987; and U.S. Pat. No. 4,723,387 Krasnoff, issued Feb. 9, 1988.

It is known in the prior art to use carbon dioxide in solid phase for use in cleaning a workpiece. In this prior art solid pellets of carbon dioxide are formed on the surface of a drum which is rotated at high speed to throw the pellets by centrifugal force against a workpiece for cleaning or other purposes.

The following patents relate to the use of cryogenic fluids in connection with cutting apparatus or methods. The Lightstone et al U.S. Pat. No,. 3,979,981, issued Sep. 14, 1976 discloses a method for shearing metal in which the metal is cooled to a cryogenic temperature and using shearing operations such as slitting, punching, and blanking. The Lightstone et al U.S. Pat. No. 3,900,975, issued Aug. 26, 1975 discloses a process for abrasively grinding copper in which the copper workpiece is cooled to a cryogenic temperature. The Elkins U.S. Pat. No. 4,447,952, issued May 15, 1984 describes an underwater cutting or penetrating device which uses a source of liquid nitrogen for cooling a workpiece before impact by an explosively driven member. The Bryne U.S. Pat. No. 3,712,306, issued Jan. 23, 1973 discloses a cryosurgical instrument which has an open ended chamber pressed into contact with tissue. A stream of liquified nitrogen impinges directly on the tissue which is to be necrotized by freezing. The Bettin U.S. Pat. No. 4,262,567, issued Apr. 21, 1981 and the Hagler U.S. Pat. No. 4,918,941, issued Apr. 24, 1990 disclose the use of cryogenic fluids for cooling microtomes.

A general object of this invention is to provide an improved method and apparatus for material removal by a high velocity stream impinging on the workpiece and to overcome certain disadvantages of the prior art.

SUMMARY OF THE INVENTION

In accordance with this invention, method and apparatus are provided for material removal from a solid workpiece using a high velocity jet stream formed from a working liquid and containing solid particles but which leaves no solid residue. This is accomplished by producing a high speed jet stream containing needles or particles of ice.

In accordance with this invention, solid material is removed from a workpiece by supplying a pressurized working liquid to a discharge nozzle having an orifice for emitting a needle-like stream at high velocity. The working liquid is cooled before it reaches the nozzle to a temperature below its freezing point whereby at least some of the stream is in a solid phase state. The stream issuing from the orifice is caused to impinge on the workpiece to dislodge solid material therefrom. Optionally, the stream may be cooled after it is emitted from the orifice to maintain it below its freezing point between the orifice and the workpiece. Preferably, the pressurized working liquid is water which is cooled by a cryogenic fluid.

A complete understanding of this invention will be obtained from the detailed description that follows taken with the accompanying drawings.

BEST MODE FOR CARRYING OUT THE INVENTION

Figure 1:
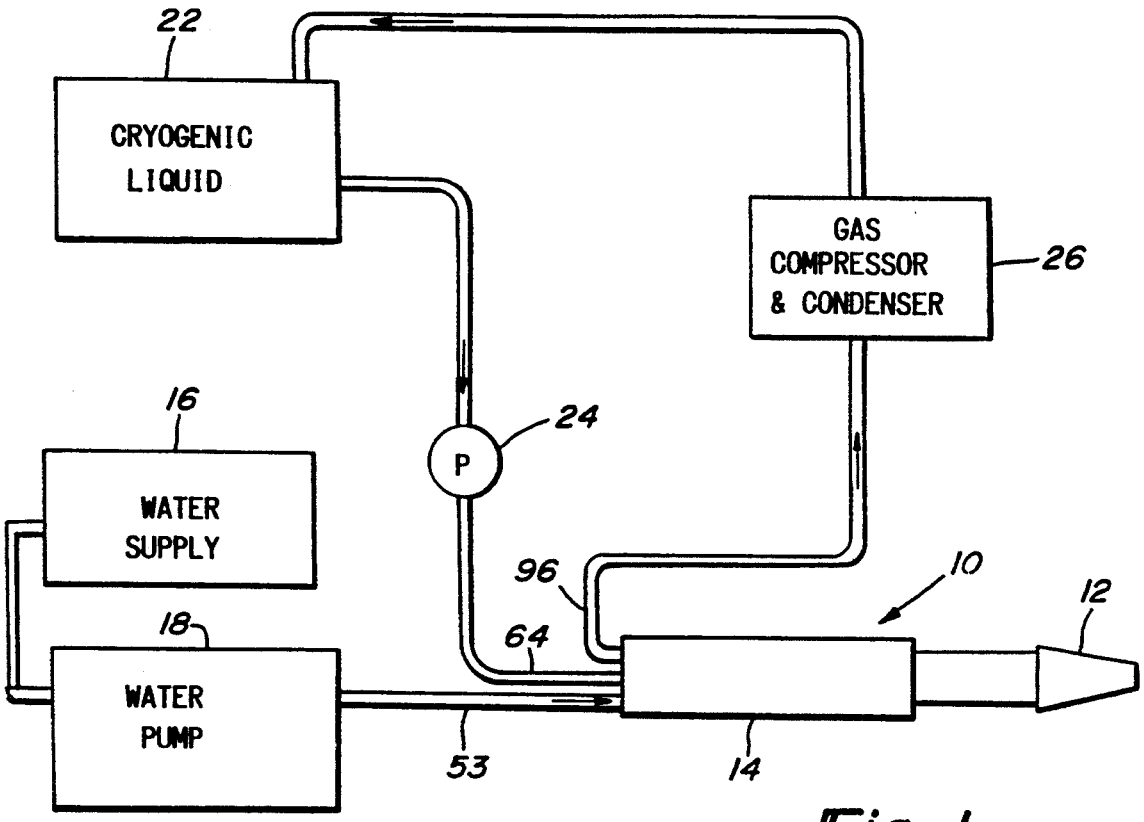
FIG. 1 is a diagram of the apparatus embodying this invention.

Referring now to the drawings, there is shown an illustrative embodiment of the invention in a material removing apparatus which is especially adapted for cutting of stone and concrete. It will be appreciated, as the description proceeds, that the invention may be embodied in different forms and may be utilized in a wide variety of applications.

The material removing apparatus of this invention is illustrated in FIG. 1 in diagrammatical form. It comprises, in general, a cutting tool 10 including a nozzle 12 and a charge forming barrel 14. The cutting tool 10 is supplied with a working liquid, specifically water, from a water supply source 16 through a high pressure pump 18. For the purpose of freezing the water as it is emitted from the nozzle 12, the cryogenic liquid supply source 22 is connected through a pump 24 to the tool 10. For the purpose of conserving the cryogenic material, at least a portion of the cryogenic gas which flows through the charge forming barrel 14 is returned through a gas compressor and condenser 26 to the supply source 22.

Figure 3:
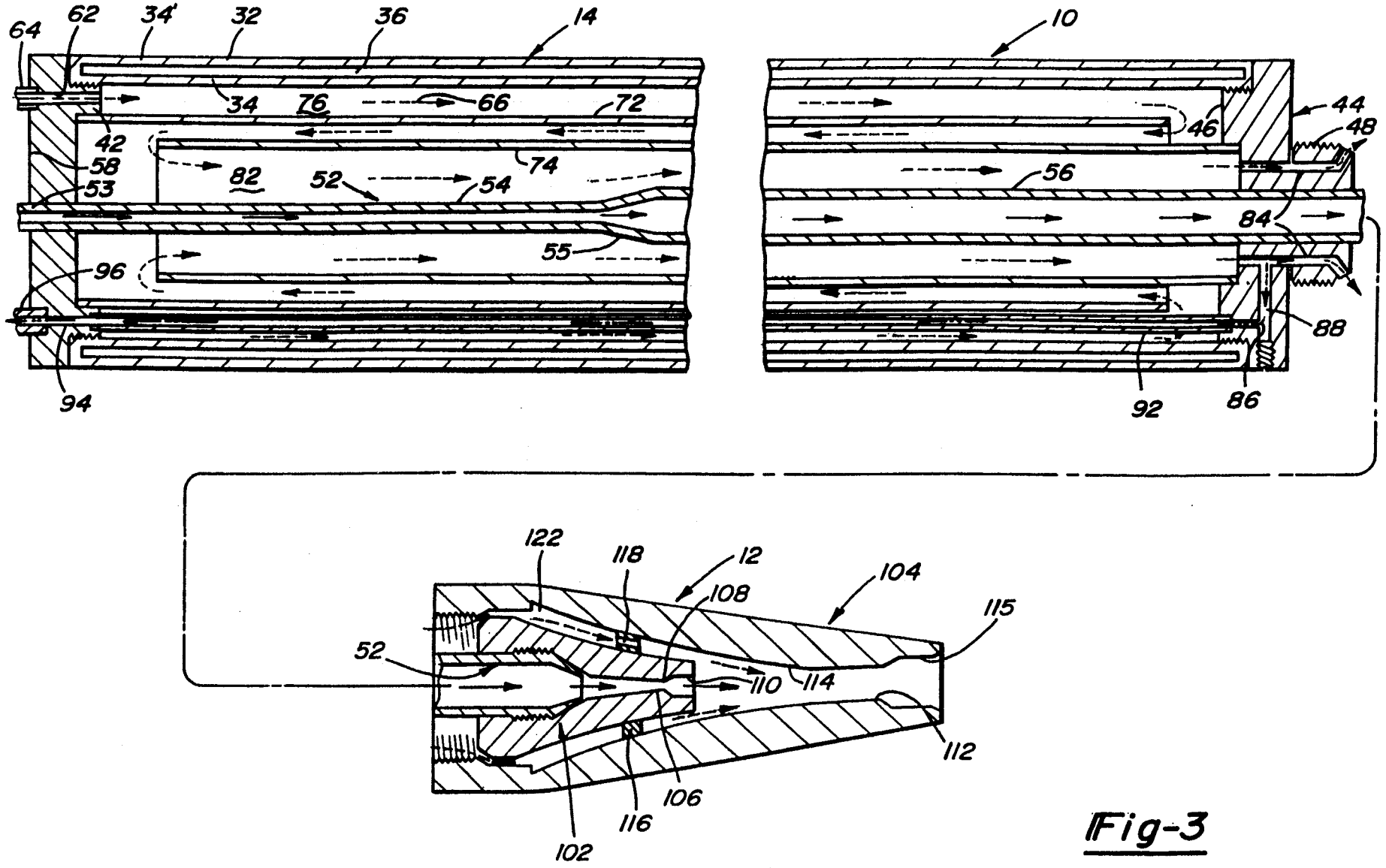
FIG. 3 shows certain details of construction of the apparatus of FIG. 1.

The cutting tool 10 will be described in greater detail with reference to FIG. 3. The charge forming barrel 14 comprises an insulating cylindrical sleeve 32 of double wall construction. The inner and outer walls 34 and 34' are radially spaced and hermetically joined at the ends to form enclosed annular chamber 36 which is evacuated to provide thermal insulation. A rear end cap, suitably circular, is provided with an annular boss 42 which threadedly engages the cylindrical sleeve 32 and forms a gas-tight closure therewith. Similarly, a front end cap 44 is provided with an annular boss 46 which is threadedly engaged with the cylindrical sleeve 32 in gas-tight sealing engagement therewith. The front end cap 44 is provided with a unitary nozzle fitting 48 to receive the nozzle 12 which will be described subsequently.

The charge forming barrel 14 includes a centrally disposed water conduit 52 extending axially through the rear end cap 38, the cylindrical sleeve 32 and the nozzle fitting 48. The inlet end of the conduit 52 is connected by a water supply conduit 53 to the pump 18. The water conduit 52 has a section 54 of relatively small internal diameter and a section 56 of relatively large internal diameter, the sections being joined by an expansion throat 58. As will be described, water is flowed through the water conduit 52 at very high pressure from the pump 18. A flow regulating valve may be connected in the supply conduit 53 to permit adjustment of flow to a desired value.

The water in the conduit 52 is refrigerated by a flow of cryogenic fluid in the charge forming barrel 14 to transform the water from liquid phase to solid phase in the form of ice crystals as will be described. Refrigeration of the water in the conduit 52 is provided by a cryogenic fluid evaporator in heat exchange relation with the conduit in the charge forming barrel 14. The evaporator comprises an expansion chamber with a retroverted flow path for the cryogenic fluid. The flow path enters the charge forming barrel 14 through a passage 62 which is connected by a conduit 64 to the cryogenic liquid pump 24. The flow path for the cryogenic fluid is indicated by the dashed-line arrows 66. The path is defined by a pair of coaxial sleeves 72 and 74, the former being secured in the annular boss 42 of the rear end cap 38 and the latter being secured in the annular boss 46 of the front end cap 44. Thus, the gas is constrained to flow in an outer annular passage 76 between the insulating cylindrical sleeve 34 and the sleeve 72 in the forward direction and then in the reverse direction through an intermediate annular passage 78 between the sleeves 72 and 74. In a final pass, the cryogenic fluid flows in the inner annular passage 82 between the sleeve 74 and the water conduit 52. In order to supply the cryogenic fluid to the nozzle 12, the nozzle fitting 48 is provided with plural axial passages 84 extending from the passage 82 to the nozzle 12, which will be described subsequently.

For the purpose of conserving the cryogenic fluid which is not supplied to the nozzle 12, a return flow path, indicated by the interrupted line arrows 86, is provided in the charge forming barrel 14. This return flow path includes a passage 88 in the front end cap 44 which intersects one of the passages 84. It also includes a tube 92 extending from the passage 88 throughout the length of the barrel 14 to a passage 94 in the rear end cap 38. A conduit 96 connects the passage 94 in the rear end cap 38 to the gas compressor and condenser 26.

The nozzle 12 comprises an inner nozzle member 102 and a coaxial outer nozzle member 104. The inner nozzle member is mounted on the forward end of the water conduit 52 by a threaded connection. It is provided with a conical nose and an axially extending venturi passage 106 having a throat 108 of reduced diameter leading to an orifice 110 of somewhat larger diameter. An outer nozzle member 104 is provided with a tapered bore 114, somewhat conical in shape. The bore 114 has a minimum diameter at an orifice 112 and has a larger diameter at mouth 115. The bore 114 terminates at its rear end in a cylindrical threaded opening which is threadedly engaged with the nozzle fitting 48. An annular orifice plate 116 is disposed over the conical nose of the inner nozzle member 102 in conforming engagement therewith and has a conforming engagement at its outer periphery with the tapered wall of the bore 114 in the outer nozzle member 104. The orifice plate 116 is provided with a plurality, suitably six, orifices 118. An annular passage 122 is defined between the inner wall of the outer nozzle 104 and the outer wall of the inner nozzle 102 and extends from the axial passages 84 in the fitting 48 to the orifices 118 in the orifice plate 116 to provide for a regulated flow of cryogenic fluid therethrough.

Figure 2:
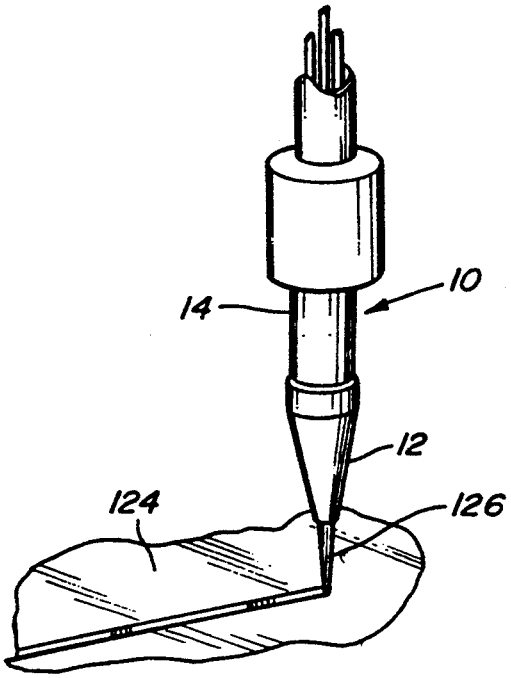
FIG. 2 shows the apparatus in relation to a workpiece.

In operation, as depicted in FIG. 2, the cutting tool 10 is adapted to remove material from a stone workpiece 124 by emitting a needle-like stream 126 of ice or particles of ice which impinges at high velocity against the workpiece. Water is delivered by the water pump 18 at very high pressure through the supply conduit 53 to the water conduit 52 of the charge forming barrel 14. There is a pressure drop and reduction in flow rate at the expansion throat 58 and through the conduit section 56 between the throat 58 and the inner nozzle 102. The cryogenic liquid from the source 22 is supplied by the pump 24 through the conduit 64 to the inlet passage 62 in the charge forming barrel 14. The annular passages 76, 78 and 82, which are of greatly increased cross-sectional area compared with the inlet passage 62, serve as an evaporator in which the cryogenic liquid vaporizes and flows through the annular passages in gaseous form. This produces a refrigerating effect on the water conduit 52 and the high pressure water stream therein is frozen into a column of ice. The stream of water under high pressure in the small diameter section 54 of the conduit 52 is in a supercooled state. In this section 54, the temperature is below the freezing point of water but the water therein remains in the liquid state due to the high pressure. At the expansion throat 58 the pressure on the water decreases and sufficient expansion is permitted to allow transformation to the solid state in the form of a column of ice. The column of ice is forced by the high pressure water behind it through the venturi passage 106 in the inner nozzle member 102 and is emitted therefrom. There is a needle-like stream moving at high velocity through the orifice 112 in the outer nozzle member 104. A portion of the cryogenic gas in the charge forming barrel 14, pressurized by the expansion therein, is forced through the passages 84 to the nozzle fitting 48 and into the annular passage 122 of the nozzle 12. The cryogenic gas flows through the orifices 118 in the orifice plate 116 and forms an envelope or sheath of cryogenic gas around the needle-like stream of ice which is projected at high velocity through the orifice 112. Thus, the gaseous sheath, which is below the freezing point of water, maintains the needle-like stream of ice in the solid state as it impinges upon the workpiece surface.

An example of a design of the cutting tool 10 is as follows. The tool is designed to use liquid nitrogen as the cryogenic liquid with water as the working liquid. The water pump 18 has the capacity to deliver water at 20,000 PSI through the supply conduit 53 at a flow rate of twelve gallons per minute to the inlet of the water conduit 52 on the charge forming barrel 14. The cryogenic liquid pump 24 has the capacity to deliver cryogenic liquid nitrogen through the conduit 64 at a pressure of 350 PSI to the inlet passage 62 in the charge forming barrel 14. Selected dimensions of the charge forming barrel and nozzle are as follows:

Charge forming barrel 14: Length=20 ft., Diameter=2 in.;

Inlet passage 62: Inside Diameter (I.D.)=3/16 in.;

Section 54 of water conduit 52: Length=5 ft., I.D.=1/16 in.;

Section 56 of water conduit 52: Length=15 ft., I.D.=$\frac{1}{8}$ in.

Nozzle fitting 48, six passages 84: Diameter=1/16 in.

Orifice plate 116, six orifices 118: Diameter=0.0052 in.;

Nozzle member 104: Orifice 112, diameter=$\frac{1}{4}$ in., Mouth 115, diameter=3/16 in.;

Nozzle member 102: Venturi throat 108, Diameter=0.052 in., Orifice 110, Diameter=0.062 in.

It will be understood that the cutting tool 10 of this invention may be used with working liquids other than water such as liquids having a suitably high freezing point or mixtures of water and other liquids or water with dissolved chemicals. Also, it will be understood that cryogenic fluids other than liquid nitrogen may be employed such as liquid carbon dioxide.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A method of removing solid material from a workpiece which comprises the steps of:

supplying a pressurized working liquid through a conduit having an outer surface and an orifice for emitting a high pressure stream of at least partially solidified working liquid, removing heat from said conduit via said outer surface such that said conduit is cooled to a temperature sufficient to cause solidification of at least some of said working liquid within said conduit, and impinging said stream on the workpiece to dislodge solid material therefrom.

2. The invention as defined in claim 1 including the step of:

cooling said stream after it is emitted from said orifice to maintain said stream below its freezing point between said orifice and the workpiece.

3. The invention as defined in claim 2 wherein:

said working liquid is cooled before reaching said orifice by a cryogenic fluid, and said stream is cooled after being emitted by surrounding said stream with a flowing sleeve of gaseous-phase cryogenic fluid.

4. The invention as defined in claim 3 wherein said cryogenic fluid is liquid nitrogen.

5. The invention as defined in claim 3 wherein said cryogenic fluid is liquid carbon dioxide.

6. The invention as defined in claim 1 wherein said pressurized working liquid is water.

7. A method of cutting a solid workpiece, comprising the steps of:

forcing a high pressure stream of working liquid through a conduit located within a cutting tool, removing heat from within said conduit in an amount sufficient to cause solidification of at least some of said working liquid to thereby form solid particles within said stream, and impinging said stream on the workpiece.

8. The invention as defined in claim 7, wherein said working liquid is water and said heat removing step further comprises cooling said conduit with a cryogenic fluid.

9. A method of cutting a solid workpiece, comprising the steps of:

forcing a high pressure stream of working liquid through a conduit located within a cutting tool, lowering the temperature of said conduit to a temperature sufficient to cause solidification of at least some of said working liquid to thereby form solid particles within said stream, and impinging said stream on the workpiece, wherein said forcing step further comprises forcing said working liquid through a first section of said conduit having a first internal diameter and thereafter forcing said working liquid through a second section of said conduit having a second internal diameter that is greater than said first internal diameter to thereby facilitate solidification of said working liquid.

10. An apparatus for removing solid material from a workpiece, comprising:

a high pressure pump for supplying a liquid working material, a conduit coupled to said pump to receive the liquid working material, said conduit having an orifice for emitting a stream containing at least partially solidified working material, and cooling means for removing heat from within said conduit to thereby cause solidification of at least some of the working material contained in said conduit.

11. An apparatus as defined in claim 10, wherein said cooling means comprises an evaporator in heat exchange relationship to said conduit.

12. An apparatus as defined in claim 11, wherein said cooling means further comprises:

a reservoir for holding a supply of cryogenic fluid, a condenser for liquifying gaseous cryogenic fluid, and a pump for circulating at least a portion of the cryogenic fluid among said reservoir, evaporator, and condenser.

13. An apparatus as defined in claim 11, further comprising a nozzle located to receive the stream emitted from said orifice, said nozzle having a mouth for emitting the stream and a passage communicating with said evaporator to provide a supply of cryogenic fluid from said evaporator to the stream to thereby maintain the solidified working material emitted from said orifice in the solid-phase state.

* * * * *